US008146789B2

(12) United States Patent
Hu et al.

(10) Patent No.: US 8,146,789 B2
(45) Date of Patent: Apr. 3, 2012

(54) HAMMER TACKER

(75) Inventors: Chih-Wei Hu, Taichung Hsien (TW); Qi-Fu Liao, Taichung Hsien (TW)

(73) Assignee: Apex Mfg. Co., Ltd, Taichung Hsien (TW)

( * ) Notice: Subject to any disclaimer, the term of this patent is extended or adjusted under 35 U.S.C. 154(b) by 0 days.

(21) Appl. No.: 12/764,857

(22) Filed: Apr. 21, 2010

(65) Prior Publication Data

US 2011/0248065 A1 Oct. 13, 2011

(30) Foreign Application Priority Data

Apr. 7, 2010 (TW) ..... 99110708 A

(51) Int. Cl.
*B25C 5/11* (2006.01)

(52) U.S. Cl. ..... 227/133; 227/120; 227/148

(58) Field of Classification Search ..... 227/120, 227/132, 133, 148
See application file for complete search history.

(56) References Cited

U.S. PATENT DOCUMENTS 1,687,871 A * 10/1928 Maynard ..... 227/128
2,001,092 A * 5/1935 Cavanagh ..... 227/128
2,281,232 A * 4/1942 Cavanagh ..... 227/128
2,399,374 A * 4/1946 Morberg ..... 227/133
2,431,548 A * 11/1947 Ericsson ..... 227/133
2,432,853 A * 12/1947 Barclay ..... 227/133
2,434,260 A * 1/1948 Cavanagh ..... 227/128
2,463,507 A * 3/1949 Barclay ..... 227/133
2,463,579 A * 3/1949 Vail ..... 227/147
2,466,856 A * 4/1949 Makin ..... 227/127
2,552,798 A * 5/1951 Lindstrom ..... 227/133
2,645,773 A * 7/1953 Dugin ..... 227/133
2,661,999 A * 12/1953 Morris ..... 227/133
2,757,378 A * 8/1956 King ..... 227/133
2,769,173 A * 11/1956 Lindstrom ..... 227/127
2,896,210 A * 7/1959 Rubin ..... 227/133
3,007,171 A * 11/1961 Critchley ..... 227/109
3,113,317 A * 12/1963 Carlson, Sr. et al. ..... 227/128
5,320,268 A * 6/1994 Shkolnikov et al. ..... 227/66
7,255,256 B2 * 8/2007 McGee et al. ..... 227/8
7,506,789 B2 * 3/2009 Shor ..... 227/147
7,513,404 B2 * 4/2009 Shkolnikov et al. ..... 227/8
7,654,430 B2 * 2/2010 Cho et al. ..... 227/109
2006/0249554 A1 * 11/2006 Butzen et al. ..... 227/130
2008/0173690 A1 * 7/2008 Lamb ..... 227/133
2008/0296341 A1 * 12/2008 Francescon ..... 227/119
2010/0001033 A1 * 1/2010 Chen ..... 227/120

* cited by examiner

*Primary Examiner* — Lindsay Low

(57) ABSTRACT

A hammer tacker of the present invention includes a handle, a magazine, a striker, an actuator, a transmission mechanism and an abutting element. The handle is formed with a head at one end thereof and defines a receiving chamber therein. The magazine is disposed in the receiving chamber to receive nailing units. The striker is linear-slidably disposed in the head to strike the nailing units. The actuator is linear-slidably disposed on the head. The transmission mechanism connects the actuator with the striker for the actuator and the striker to move in opposite directions. The abutting element is pivoted on the actuator. And the actuator moves upward as the abutting element hits an object.

5 Claims, 6 Drawing Sheets

HAMMER TACKER

BACKGROUND OF THE INVENTION

1. Field of the Invention

The present invention relates to a manual nailing device, and more particularly to a hammer tacker.

2. Description of the Prior Art

A conventional hammer tacker is used to nail a nail, a pin or the like into an object in the hammering manner. The hammer tacker includes an actuator and a striker. As the actuator hits the object, the striker is thus driven to strike the nail out to fix a waterproof cloth on a rooftop or under a carpet, or to fix a poster on a wall.

Unfortunately, the object and the cloth/fiber/paper are often damaged due to the serious strike of the hammer tacker. A modified hammer tacker, as shown in FIG. 6 is thus provided to mitigate the above mentioned disadvantages. The modified hammer tacker is provided with an abutting plate 2, which has a bigger contacting area with the object, attached to the actuator 1.

Nevertheless, the modified hammer tacker arises another disadvantage that the abutting plate may not contact the object in a surface-contacting manner as the hammer tacker hits the object with an angle. A noticeable gap H is shown between the striker and the object, which means the nail can not be completely struck into the object.

The present invention is, therefore, arisen to obviate or at least mitigate the above mentioned disadvantages.

SUMMARY OF THE INVENTION

The main object of the present invention is to provide a hammer tacker whose abutting element can contact the object in a surface-contacting manner.

Another main object of the present invention is to provide a hammer tacker which can strike the nail into the object as completely as possible.

To achieve the above and other objects, a hammer tacker of the present invention includes a handle, a magazine, a striker, an actuator, a transmission mechanism and an abutting element. The handle is formed with a head at one end thereof and defines a receiving chamber therein. The magazine is disposed in the receiving chamber to receive nailing units. The striker is linear-slidably disposed in the head to strike the nailing units. The actuator is linear-slidably disposed on the head. The transmission mechanism connects the actuator with the striker for the actuator and the striker to move in opposite directions. The abutting element is pivoted on the actuator. And the actuator moves upward as the abutting element hits an object.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
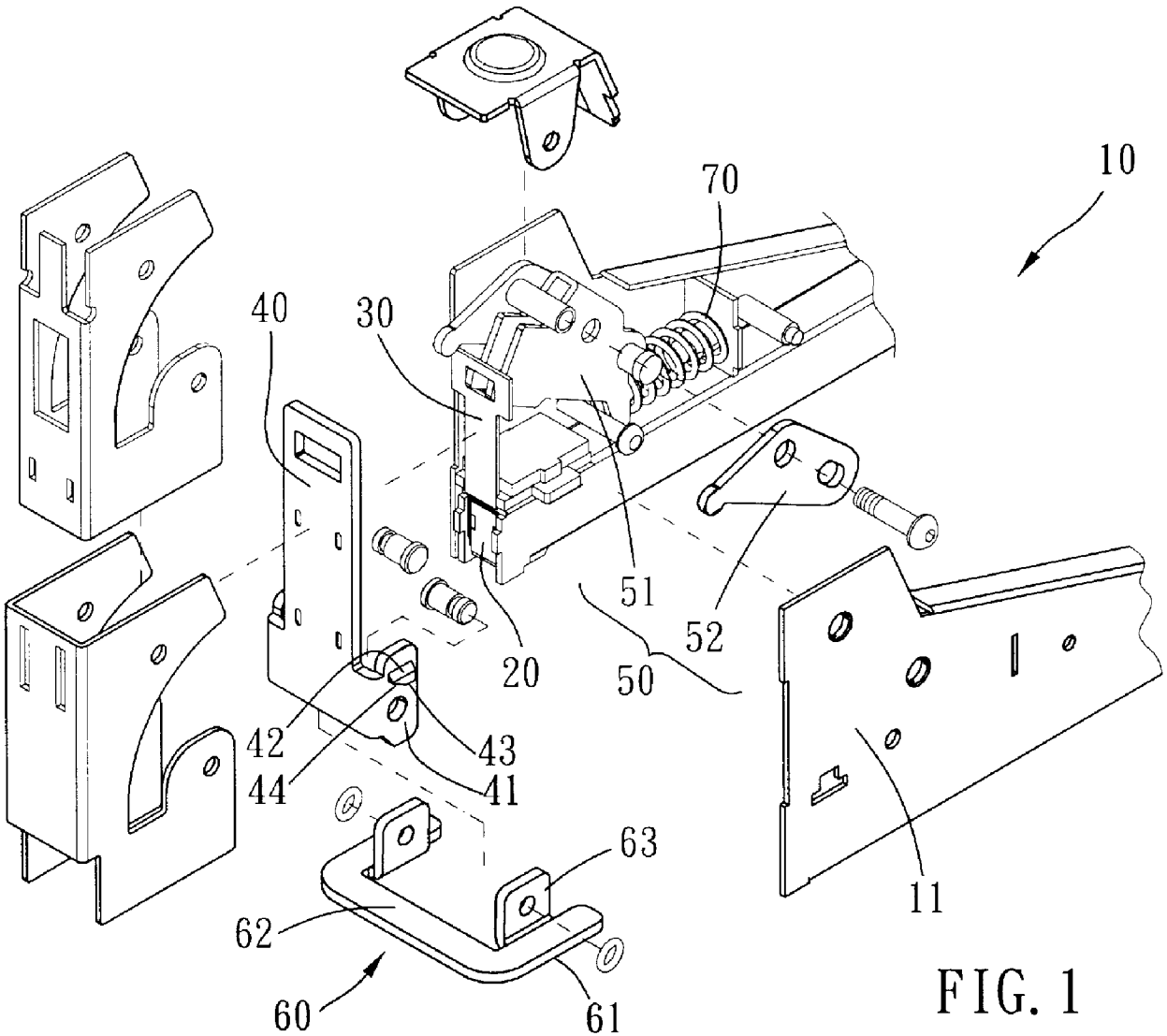
FIG. 1 is a breakdown drawing showing a hammer tacker of the present invention.
Figure 2:
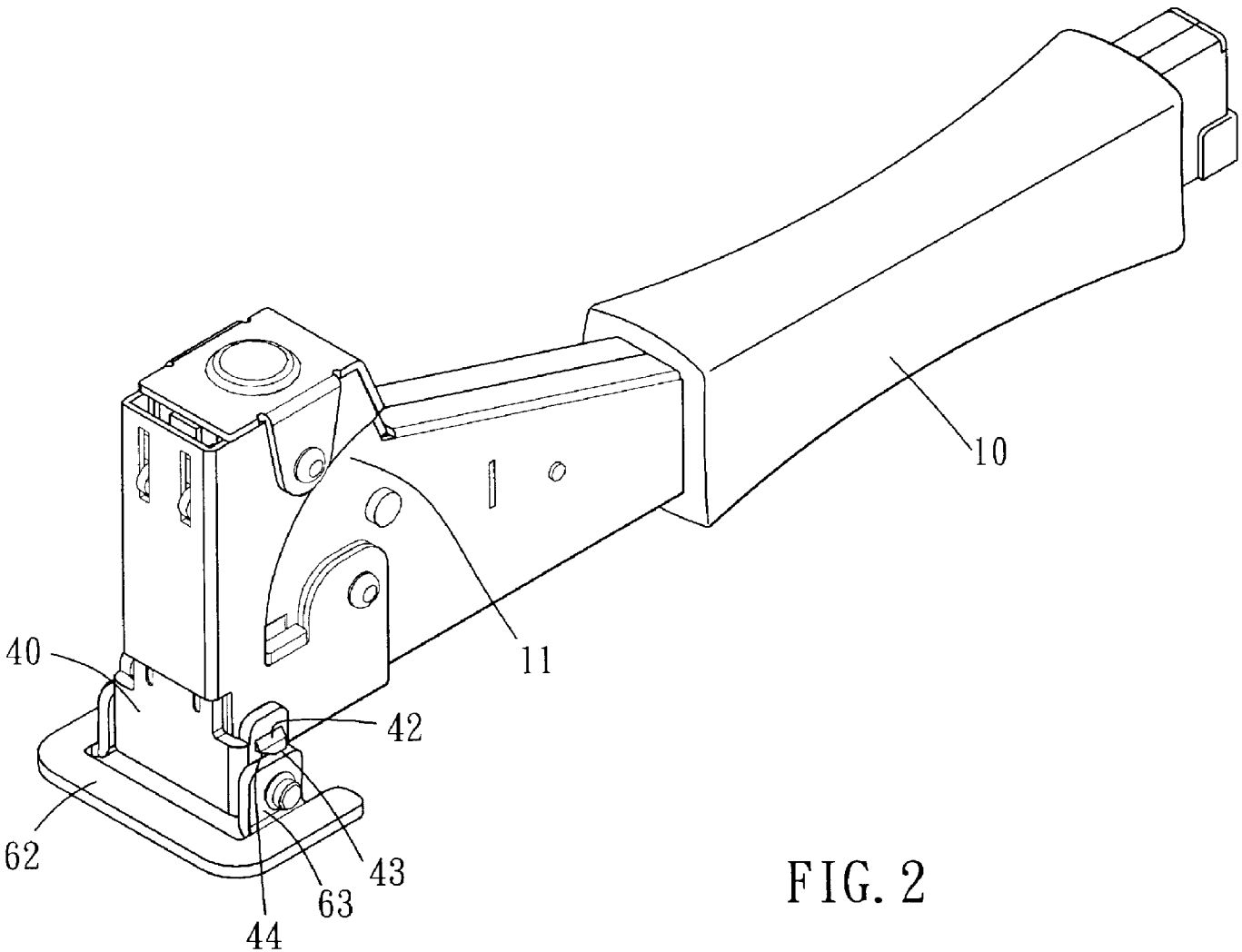
FIG. 2 is a combination drawing showing a hammer tacker of the present invention.

Please refer to FIG. 1 and FIG. 2. A hammer tacker of the present invention includes a handle 10, a magazine 20, a striker 30, an actuator 40, a transmission mechanism 50 and an abutting element 60.

The handle 10 is for the user to grip. The handle 10 is formed with a head 11 at one end thereof, and the handle 10 defines a receiving chamber therein. In the present embodiment, the handle 10 is composed of several plates, and the handle 10 is covered with soft sleeve for the user to grip comfortably.

The magazine 20 is disposed in the receiving chamber to receive nailing units, e.g. staples, pins, nails or the like. The magazine 20 is preferably slidably disposed in the receiving chamber and thus can be withdrawn from the rear end of the handle 10 for the user to replace nailing units quickly.

The striker 30 is linear-slidably disposed in the head 11. More specifically, the striker 30 is disposed in front of the magazine 20 to strike the nailing units out of an opening locating on a bottom surface of the head 11.

The actuator 40 is linear-slidably disposed on the head 11. And preferably, the actuator 40 is disposed in front of the head 11. Two pivoting sections 41 are extended from a bottom of the actuator 40, and at least one of the pivoting sections 41 is formed with a lateral protrusion 42 which has a first surface 43 and a second surface 44.

The transmission mechanism 50 connects the actuator 40 with the striker 30 for the actuator 40 and the striker 30 to move in opposite directions. That means the actuator 40 moves in a first direction as the striker 30 moves in a second direction, in which the second direction is substantially opposite to the first direction or makes a neglectable angle, e.g. 10-20 degrees, to the first direction. The transmission mechanism 50 may be a linkage rod and lever system which can change the direction of force as shown in the present embodiment. More specifically, the transmission mechanism 50 may include a first connecting element 51 and a second connecting element 52. The first connecting element 51 is adapted to drive the striker 30 to move linearly, while the second connecting element 52 connects between the first connecting element 51 and the actuator 40. Thereby, the striker 30 can be driven downward to strike out the nailing units as the actuator 40 moves upward.

To return the striker 30 and the actuator 40 back to their original positions, a resilient member 70 can be disposed on one of the striker 30, the actuator 40 and the transmission mechanism 50. In the present embodiment, the resilient member 70 abuts against the first connecting element 51 for reposition purposes.

The abutting element 60 is pivoted on the actuator 40. And when the abutting element 60 hits an object, the abutting element 60 might move the actuator 40 upward. Meanwhile, the striker 30 will also move due to the help of the transmission mechanism 50. More specifically, the abutting element 60 pivots about an axis, and the abutting element 60 has an abutting surface 61 parallel to the axis. Thus the abutting surface 61 is adapted to abut against the object, and hopefully the object may not be damaged when it is hit upon by the hammer tacker.

Figure 3:
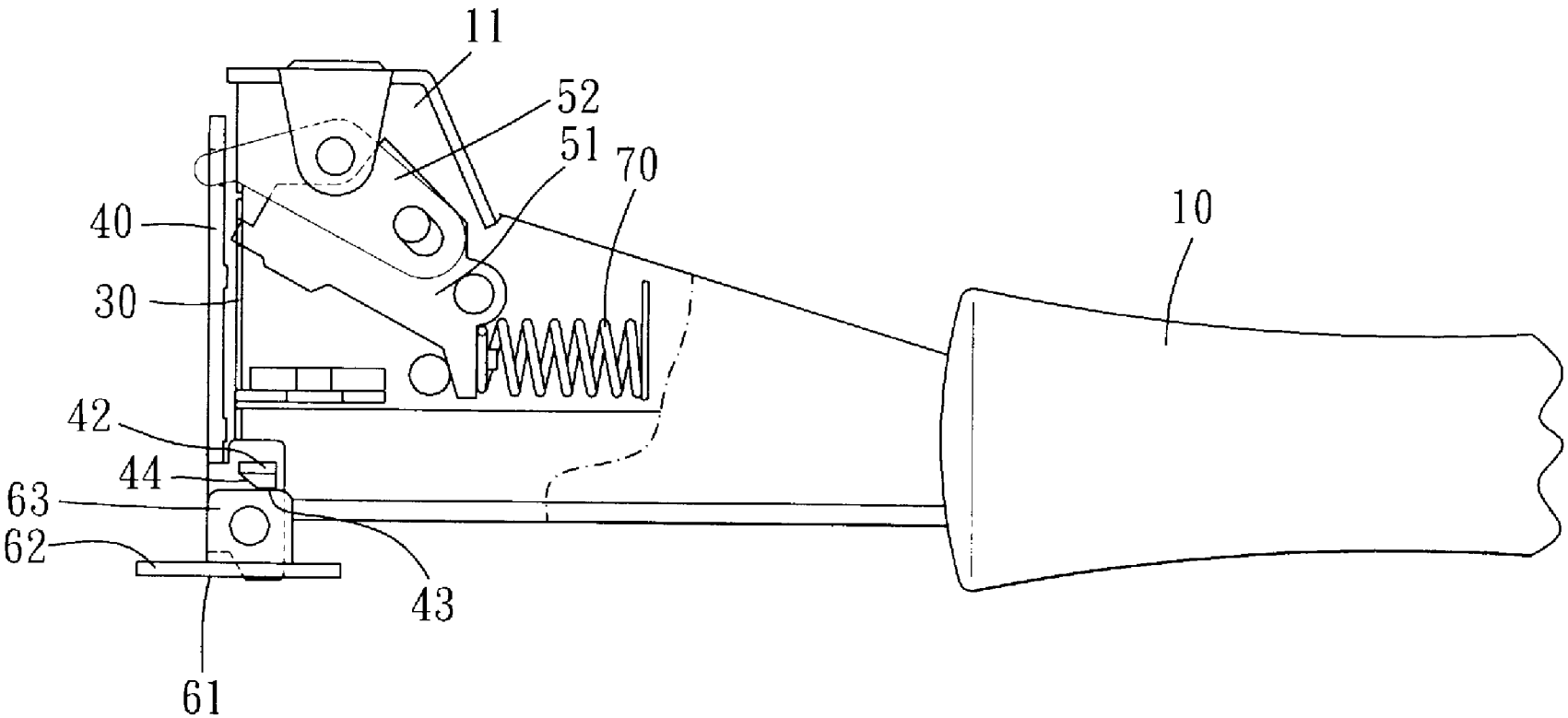
FIG. 3 is a partial transparent side view showing a hammer tacker of the present invention, wherein the abutting element locates at the first position.
Figure 4:
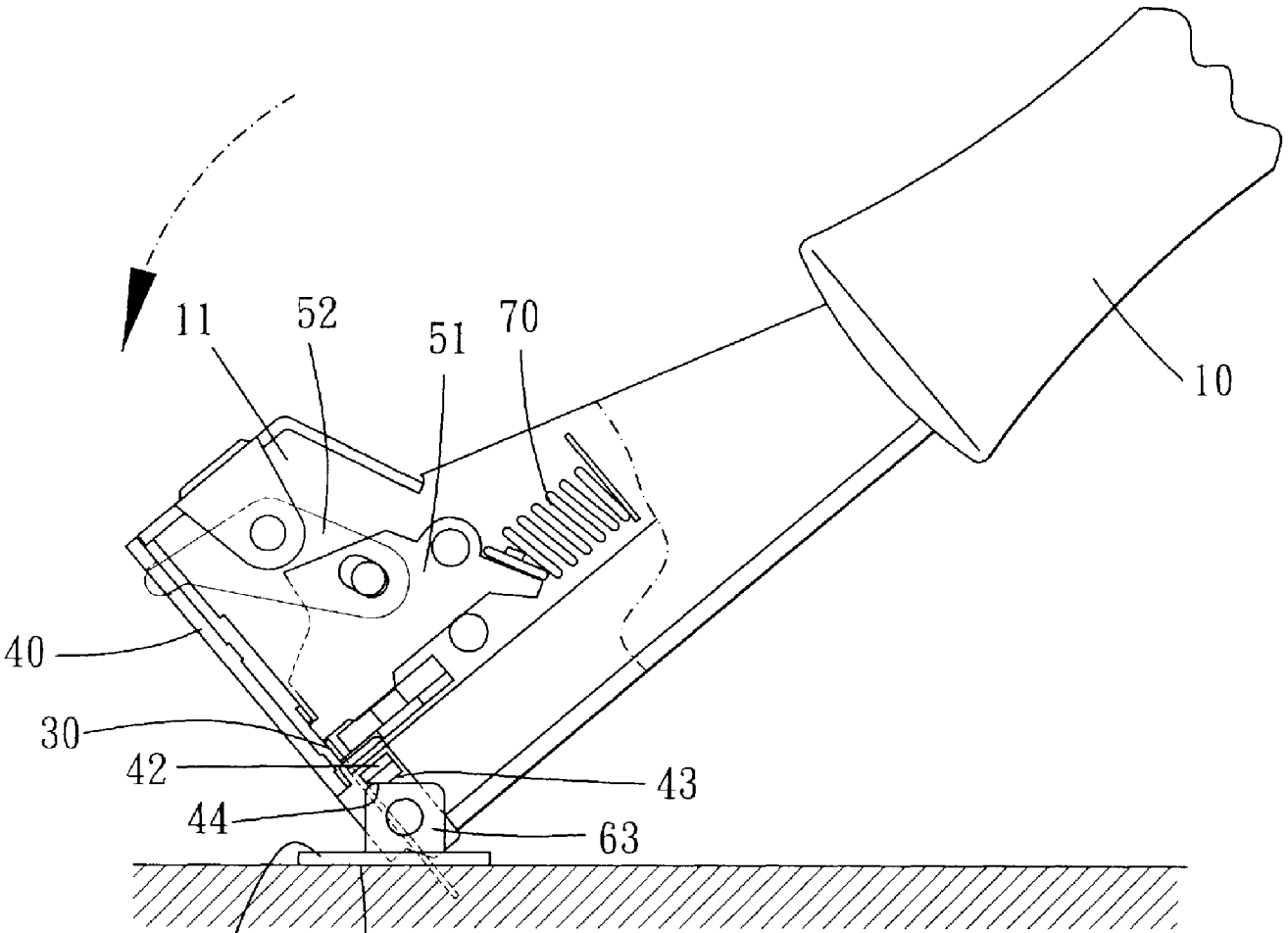
FIG. 4 is a partial transparent side view showing a hammer tacker of the present invention, wherein the abutting element locates at the second position.

In the present embodiment, the abutting element 60 includes two pivoting ears 63 and an n-shaped plate 62 connecting between the pivoting ears 63, and the pivoting ears 63 pivot on the pivoting sections 41 respectively. The n-shaped plate 62 preferably has an open side facing the magazine so as not to block the bottom opening of the head 11. Thus, the axis of the abutting element 60 is perpendicular to the magazine. The abutting element 60 is swayable between a first position and a second position. As shown in FIG. 3, the pivoting ear 63 is stopped by the first surface 43 as the abutting element 60 locates at the first position. As shown in FIG. 4, the pivoting ear 63 is stopped by the second surface 44 as the abutting element 60 locates at the second position. Because the swayable angle of the abutting element 60 is confined, the angle between the nailing unit and the object is thus controlled. As such, the situation that the nailing unit is too slanted to be successfully struck into the object is prohibited.

Figure 5:
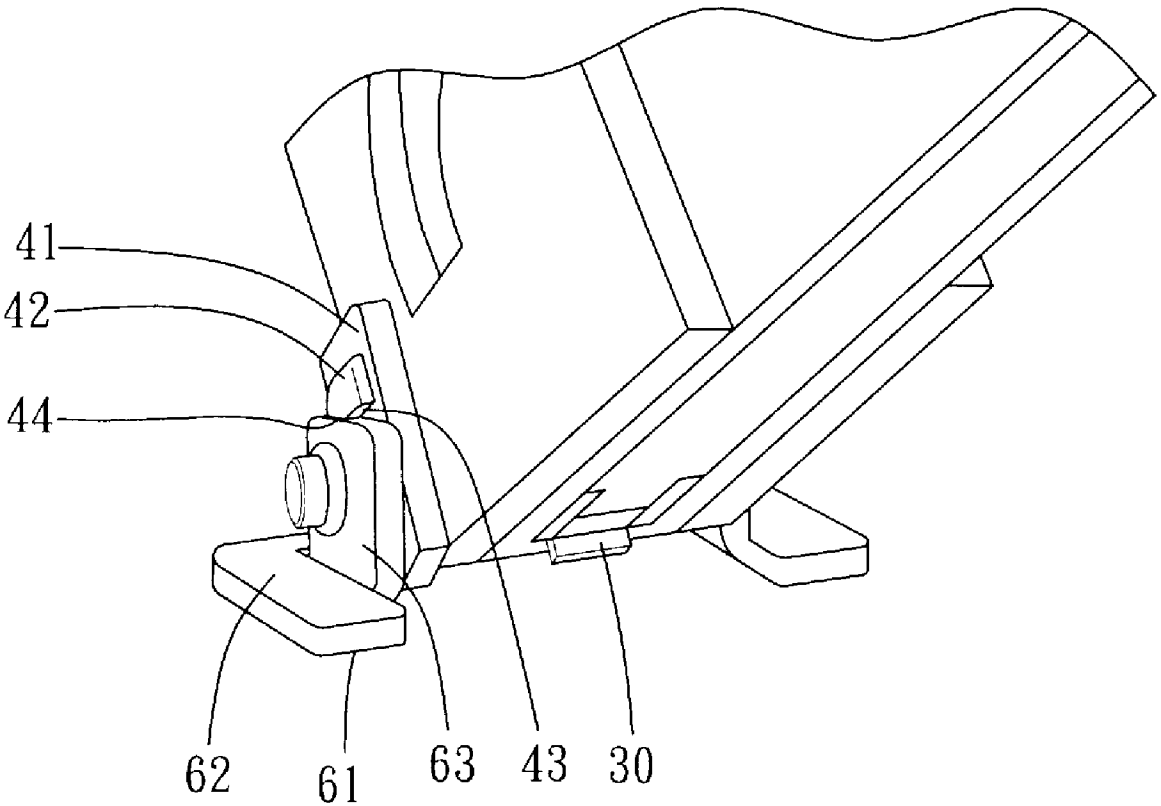
FIG. 5 is a partial perspective drawing showing a hammer tacker of the present invention.
Figure 6:
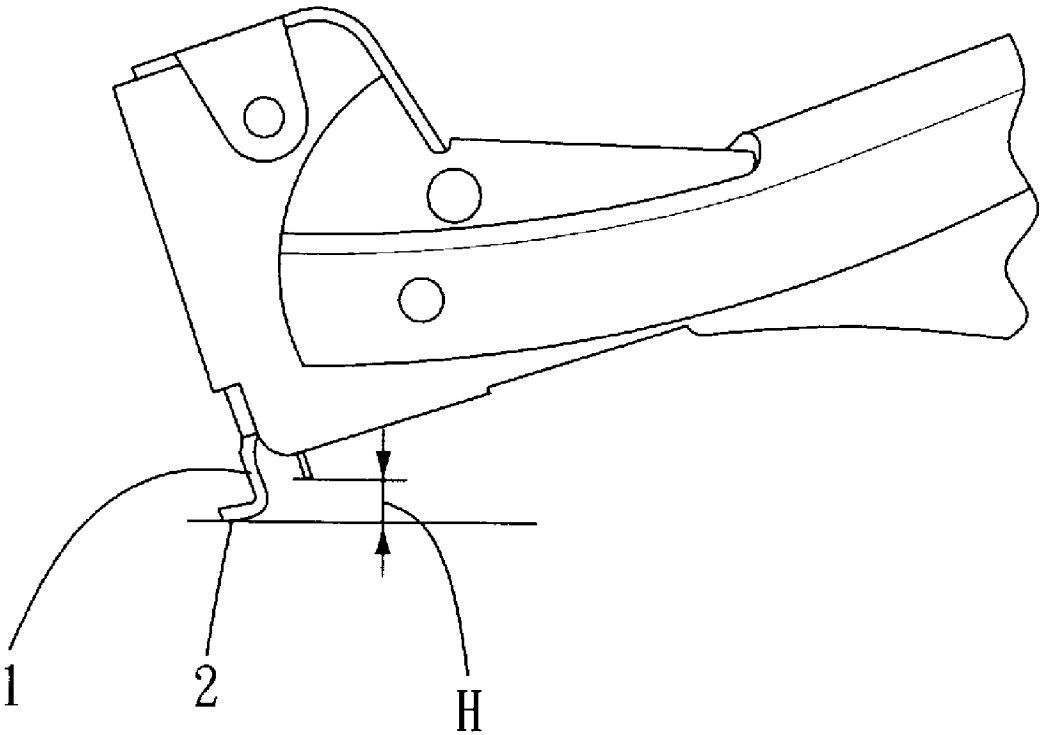
FIG. 6 PRIOR ART
FIG. 6 is a side view showing a conventional hammer tacker.

As shown in FIG. 5, the abutting surface 61 can contact the object in a surface-contacting manner because the abutting element 60 is swayable with respect to the actuator. Also, the gap between the striker 30 and the object is adjusted by the sway of the abutting element 60, so that the gap can remain within a neglectable range. As such, the nailing units can be nailed into the object as completely as possible.

What is claimed is:

1. A hammer tacker, comprising a handle, being formed with a head at one end thereof, the handle defining a receiving chamber therein;

a magazine, disposed in the receiving chamber to receive nailing units:

a striker, being linear-slidably disposed in the head to strike the nailing units;

an actuator, being linear-slidably disposed on the head;

a transmission mechanism, connecting the actuator with the striker for the actuator and the striker to move in opposite directions;

an abutting element, being pivoted on the actuator, the actuator moving upward as the abutting element hits an object;

wherein two pivoting sections are extended from a bottom of the actuator, the abutting element comprises two pivoting ears and an n-shaped plate connecting between the pivoting ears, the pivoting ears pivot on the pivoting sections respectively.

2. The hammer tacker of claim 1, wherein the abutting element pivots about an axis, the abutting element has an abutting surface parallel to the axis, the abutting surface is adapted to abut against the object.

3. The hammer tacker of claim 1, wherein the actuator has at least one lateral protrusion, the lateral protrusion has a first surface and a second surface, the abutting element is swayable between a first position and a second position;

wherein the abutting element is stopped by the first surface as the abutting element locates at the first position;

where the abutting element is stopped by the second surface as the abutting element locates at the second position.

4. The hammer tacker of claim 1, wherein at least one pivoting section is formed with a lateral protrusion, the lateral protrusion has a first surface and a second surface, the abutting element is swayable between a first position and a second position;

wherein the pivoting ear is stopped by the first surface as the abutting element locates at the first position;

wherein the pivoting ear is stopped by the second surface as the abutting element locates at the second position.

5. The hammer tacker of claim 1, wherein the actuator is disposed in front of the head, the n-shaped plate has an open side facing the magazine.

* * * * *